US007180244B2

(12) United States Patent
Lee

(10) Patent No.: US 7,180,244 B2
(45) Date of Patent: Feb. 20, 2007

(54) ELECTRO-LUMINESCENCE DISPLAY DEVICE AND DRIVING METHOD THEREOF

(75) Inventor: Han Sang Lee, Gyeonggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 230 days.

(21) Appl. No.: 11/024,650

(22) Filed: Dec. 30, 2004

(65) Prior Publication Data

US 2005/0212445 A1 Sep. 29, 2005

(30) Foreign Application Priority Data

Mar. 25, 2004 (KR) ..... 10-2004-0020349

(51) Int. Cl.
*G09G 3/10* (2006.01)

(52) U.S. Cl. ..... 315/169.1; 315/169.3; 345/92; 345/82; 345/77; 345/55

(58) Field of Classification Search ..... 315/169.1, 315/169.3; 345/76, 77, 82, 84, 45, 46, 55, 345/92, 98, 100
See application file for complete search history.

(56) References Cited

U.S. PATENT DOCUMENTS

| | | | | |
|---|---|---|---|---|
| 6,084,579 | A * | 7/2000 | Hirano | 345/205 |
| 6,229,506 | B1 * | 5/2001 | Dawson et al. | 345/82 |
| 6,229,508 | B1 * | 5/2001 | Kane | 345/82 |
| 6,989,826 | B2 * | 1/2006 | Kasai | 345/204 |
| 7,088,330 | B2 * | 8/2006 | Nagata et al. | 345/100 |
| 7,106,281 | B2 * | 9/2006 | Kim et al. | 345/76 |

* cited by examiner

*Primary Examiner*—Haissa Philogene
(74) *Attorney, Agent, or Firm*—Morgan, Lewis & Bockius, LLP

(57) ABSTRACT

An electro-luminescence display device includes an electro-luminescence panel having a plurality of pixels at pixel areas defined by intersections between data lines and first and second gate lines, each of the pixels including: an electro-luminescence cell connected to receive a supply voltage, and a first cell driver and a second cell driver for alternately controlling a current flow into the electro-luminescence cell.

39 Claims, 11 Drawing Sheets

ELECTRO-LUMINESCENCE DISPLAY DEVICE AND DRIVING METHOD THEREOF

The present application claims the benefit of Korean Patent Application No. P2004-20349 filed in Korea on Mar. 25, 2004, which is hereby incorporated by reference.

BACKGROUND OF THE INVENTION

1. Field of the Invention

The present invention relates to an electro-luminescence display (ELD) device, and more particularly, to an electro-luminescence display device and a driving method thereof that prevents a rise in a threshold voltage of a driving thin film transistor at each pixel and provides stable display brightness.

2. Discussion of the Related Art

Many efforts have been made to research and develop various flat display devices, such as liquid crystal display (LCD) devices, field emission display (FED) devices, plasma display panel (PDP) devices, and electro-luminescence (EL) display devices, as a substitute for cathode ray tube (CRT) devices. These flat display devices have advantageous characteristics of thin profile, lightness, and compact size. In addition, an electro-luminescence (EL) display device has another advantage in that it is a self-luminous type display capable of emitting light using a phosphorous material.

An EL display device generally is classified as an inorganic EL device if the phosphorous material includes an inorganic material or is classified as an organic EL device if the phosphorous material includes an organic compound. In general, an organic EL device includes an electron injection layer, an electron carrier layer, a light-emitting layer, a hole carrier layer and a hole injection layer disposed between a cathode and an anode. When a predetermined voltage is applied between the anode and the cathode, electrons produced from the cathode are moved, via the electron injection layer and the electron carrier layer, into the light-emitting layer, while holes produced from the anode are moved, via the hole injection layer and the hole carrier layer, into the light-emitting layer. Thus, the electrons and the holes fed from the electron carrier layer and the hole carrier layer are re-combined at the light-emitting layer, thereby emitting light.

The organic ELD generally is manufactured using a relatively simple process including a deposition process and an encapsulation process. Thus, an organic ELD has a low production cost. Further, the organic ELD can operate using a low DC voltage, thereby having a low power consumption and a fast response time. The organic ELD also has a wide viewing angle and a high image contrast. Moreover, since the organic ELD is an integrated device, the organic ELD has high endurance from external impacts and a wide range of applications.

A passive matrix type ELD that does not have a switching element has been widely used. In the passive matrix type ELD, scan lines intersect signal lines defining a plurality of pixels in a matrix-arrangement, and the scan lines are sequentially driven to excite each of the pixels. However, to achieve a required mean luminescence, a moment luminance needs to be as high as the luminance obtained by multiplying the mean luminescence by the number of lines.

There also exists an active matrix type ELD, which includes thin film transistors as switching elements within each pixel. The voltage applied to the pixels are charged in a storage capacitor Cst so that the voltage can be applied until the next frame signal is applied, thereby continuously driving the organic ELD regardless of the number of gate lines until a picture of images is finished. Accordingly, the active matrix type ELD provides uniform luminescence, even when a low current is applied.

FIG. 1 is a schematic block diagram illustrating an active matrix type electro-luminescence display device according to the related art. In FIG. 1, an active matrix type EL display device includes an EL panel 20 having pixels 28 arranged at intersections between gate lines GL and data lines DL, a gate driver 22 for driving the gate lines GL, and a data driver 24 for driving the data lines DL. The gate driver 22 sequentially applies a scanning pulse to the gate lines GL to drive the gate lines GL. In addition, the data driver 24 converts digital data signals inputted from an exterior source to analog data signals and applies the analog data signals to the data lines DL whenever the scanning pulse is supplied. Each of the pixels 28 receives the data signal from a respective one of the data lines DL when the scanning pulse is applied to a corresponding one of the gate lines GL, to thereby generate light corresponding to the data signal.

FIG. 2 is a detailed circuit diagram illustrating a pixel of the electro-luminescence display device shown in FIG. 1. As shown in FIG. 2, each of the pixels 28 includes an EL cell OEL having an anode connected to a supply voltage source VDD and a cathode connected to a cell driver 30. The cell driver 30 also is connected to the respective gate line GL, the respective data line DL and a ground voltage source GND to drive the EL cell OEL.

In addition, the cell driver 30 includes a switching thin film transistor T1, a driving thin film transistor T2, and a storage capacitor Cst. The switching thin film transistor T1 includes a gate terminal connected to the respective gate line GL, a source terminal connected to the respective data line DL, and a drain terminal connected to a first node N1. The driving thin film transistor T2 includes a gate terminal connected to the first node N1, a source terminal connected to the ground voltage source GND, and a drain terminal connected to the EL cell OEL. The storage capacitor Cst is connected between the ground voltage source GND and the first node N1.

Further, the switching thin film transistor T1 is turned ON, when a scanning pulse is applied to the respective gate line GL. When the switching thin film transistor T1 is turned ON, it applies the data signal supplied to the respective data line DL to the first node N1. Then, the data signal supplied to the first node N1 is charged into the storage capacitor Cst and applied to the gate terminal of the driving thin film transistor T2. The driving thin film transistor T2 controls a current amount I fed, via the EL cell OEL, from the supply voltage source VDD in response to the data signal, to thereby control a light-emission amount of the EL cell OEL.

Moreover, the driving thin film transistor T2 can keep a turn-ON state by the data signal charged in the storage capacitor Cst even though the switching thin film transistor T1 is turned OFF, and can still control a current amount I fed, via the EL cell OEL, from the supply voltage source VDD until a data signal at the next frame is applied. In this case, the current amount I flowing the EL cell OEL can be expressed as the following equation:

$$I = \frac{W}{2L} Cox(Vg2 - Vth)^2 \quad (1)$$

"W" represents a width of the driving thin film transistor T2, and "L" represents a length of the driving thin film transistor T2. Further, "Cox" represents a value of a capacitor provided by an insulating film forming a single layer when the driving thin film transistor T2 is manufactured. Also, "Vg2" represents a voltage value of a data signal inputted to the gate terminal of the driving thin film transistor T2, and "Vth" represents a threshold voltage value of the driving thin film transistor T2.

In the above equation (1), "W," "L," "Cox" and "Vg2" are constantly maintained irrespectively of a lapse of time. However, the threshold voltage value "Vth" of the driving thin film transistor T2 deteriorates with the lapse of time.

In particular, a positive (+) voltage is continuously supplied to the gate terminal of the driving thin film transistor T2. Specifically, the continuously applied positive voltage causes the threshold voltage Vth of the driving thin film transistor T2 to be increased with a lapse of time. In addition, as the threshold voltage Vth of the driving thin film transistor T2 increases, a current amount flowing through the EL cell OEL is reduced, thereby decreasing an image brightness and deteriorating an image quality.

FIGS. 3A and 3B are diagrams illustrating atomic arrangements of amorphous silicon, and FIG. 4 is a graph illustrating a deterioration of a driving thin film transistor of the pixel shown in FIG. 2. The driving thin film transistor T2 (shown in FIG. 2) is made from hydride amorphous silicon. Hydride amorphous silicon can be easily made in a large dimension and can be deposited on a substrate at a low temperature of less than 350° C. Thus, a majority of thin film transistors have been made using hydride amorphous silicon.

However, as shown in FIG. 3A, hydride amorphous silicon has an irregular atomic arrangement having a weak/dangling Si—Si bond 32. As shown in FIG. 3B, with the lapse of time, Si breaks from the weak bond, and electrons or holes are re-combined at the atom-departed place. Since an energy level is changed due to a variation in the atom arrangement of the hydride amorphous silicon, the threshold voltage Vth of the driving thin film transistor T2 is increased gradually into Vth', Vth" and Vth'" as shown in FIG. 4 with the lapse of time.

Accordingly, the image brightness of the electro-luminescence display device according to the related art degrades over time because the threshold voltage Vth of the driving thin film transistor T2 is increased to Vth', Vth" or Vth'" with the lapse of time. In addition, since a partial brightness reduction of the EL panel 20 produces a residual image, thereby seriously deteriorating an image quality.

SUMMARY OF THE INVENTION

Accordingly, the present invention is directed to an electro-luminescence display device and a driving method thereof that substantially obviate one or more of the problems due to limitations and disadvantages of the related art.

An object of the present invention is to provide an electro-luminescence display device and a driving method thereof wherein a rise in a threshold voltage of a driving thin film transistor provided for each pixel can be prevented to display an image with a stable brightness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, an electro-luminescence display device includes an electro-luminescence panel having a plurality of pixels at pixel areas defined by intersections between data lines and first and second gate lines, each of the pixels including: an electro-luminescence cell connected to receive a supply voltage, and a first cell driver and a second cell driver for alternately controlling a current flow into the electro-luminescence cell.

In another aspect, an electro-luminescence display device includes first and second gate lines for each horizontal line, a plurality of electro-luminescence cells for each of pixels arranged in a matrix-like manner, a first cell driver having a first driving thin film transistor for each pixel to control a current flowing into the electro-luminescence cell when a scanning pulse is applied to the first gate line, and a second cell driver having a second driving thin film transistor for each pixel to control the current flowing into the electro-luminescence cell when the scanning pulse is applied to the second gate line.

In yet another aspect, a method of driving an electro-luminescence display device having a first cell driver and a second cell driver for each of pixels arranged in a matrix-like manner includes applying a scanning pulse to first and second gate lines, applying a data signal to one of the first and second cell drivers for the pixel for an $j^{th}$ one of horizontal line (j being an integer) and supplying an inverse bias voltage to another one of the first and second cell driver for the pixel, when the scanning pulse is applied to an $j^{th}$ one of the first gate lines (GL1*j*) or an $j^{th}$ one of the second gate lines (GL2*j*), and controlling a current flowing from a supply voltage source, via an electro-luminescence cell for the pixel, to a reference voltage source based on said data signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
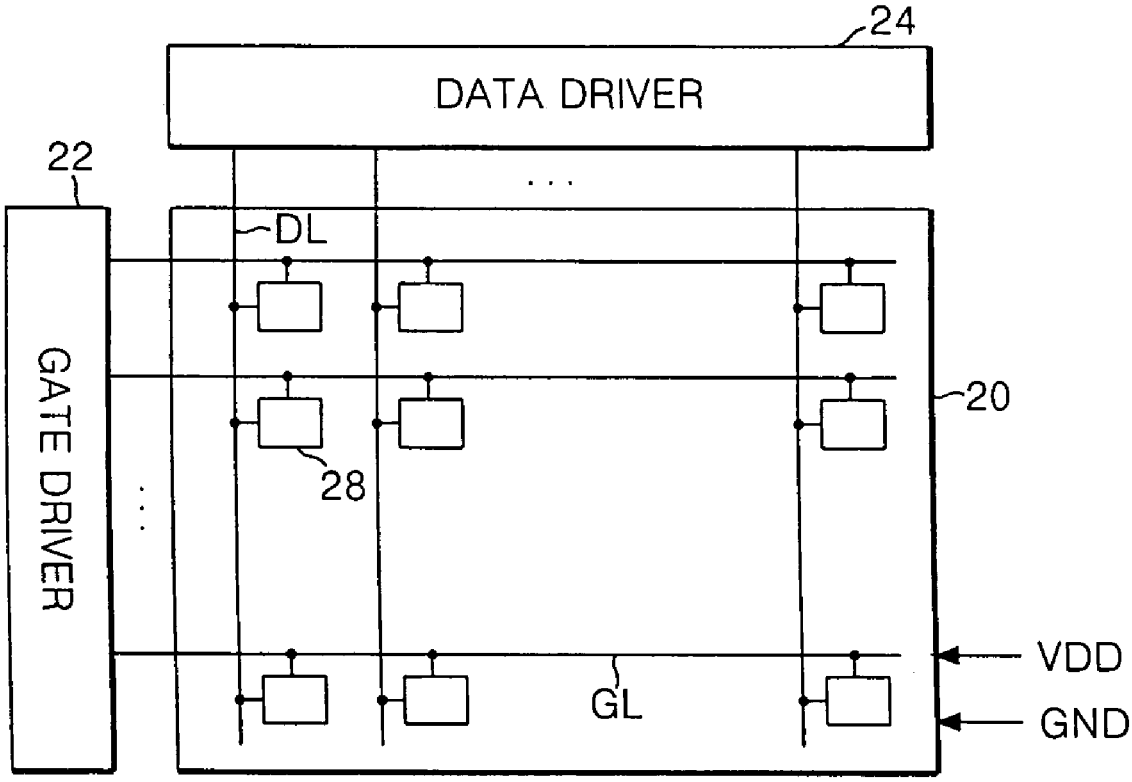
FIG. 1 RELATED ART
FIG. 1 is a schematic block diagram illustrating an active matrix type electro-luminescence display device according to the related art.
Figure 2:
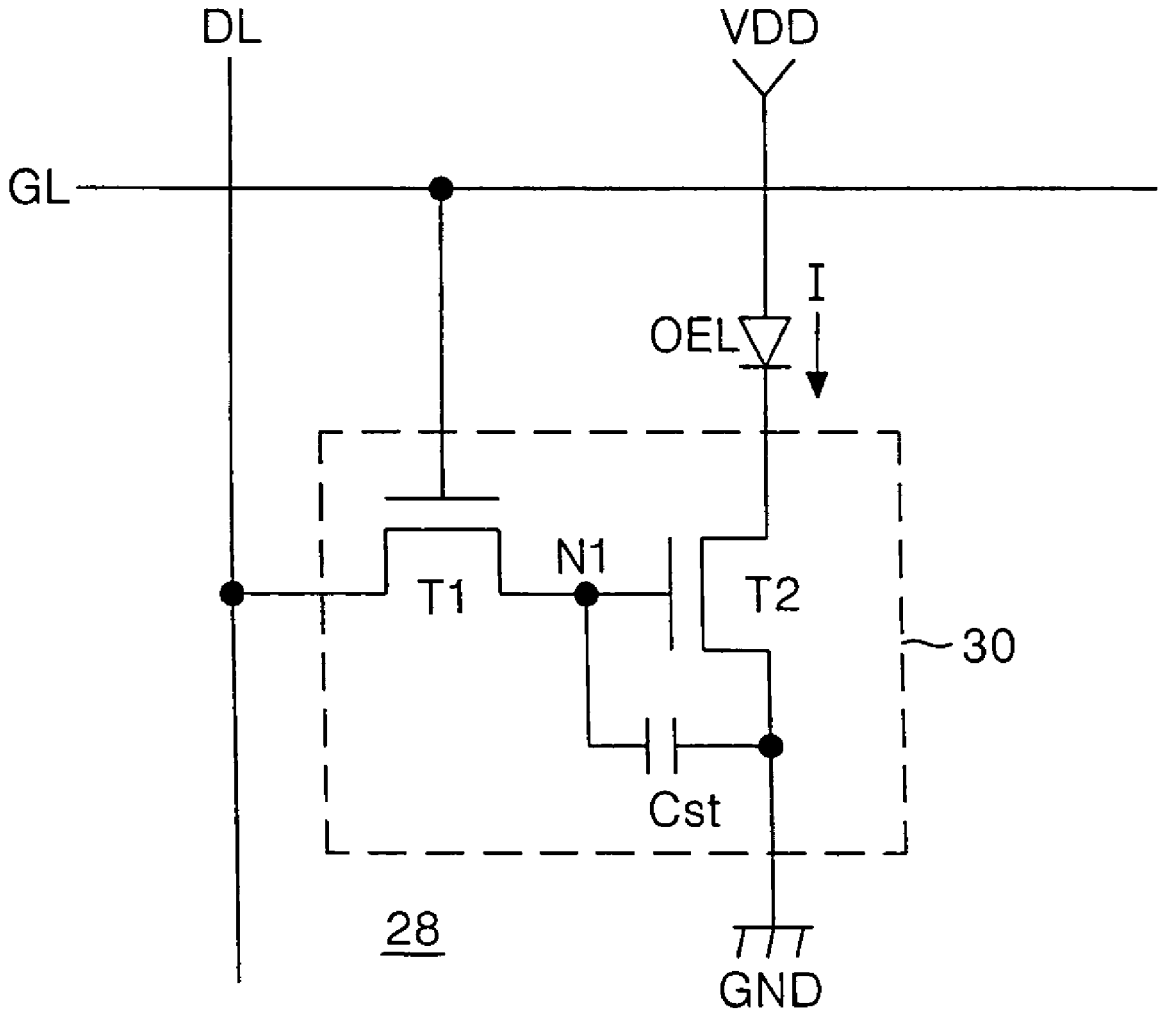
FIG. 2 RELATED ART
FIG. 2 is a detailed circuit diagram illustrating a pixel of the electro-luminescence display device shown in FIG. 1.
Figure 3A:
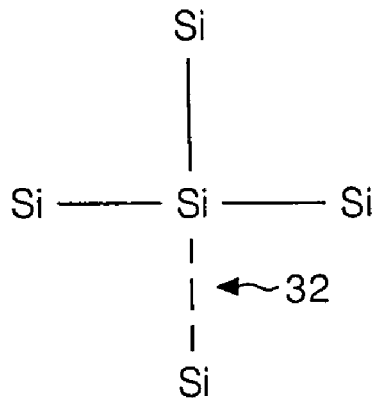
FIG.3A RELATED ART
FIGS. 3A and 3B are diagrams illustrating atomic arrangements of amorphous silicon.
Figure 3B:
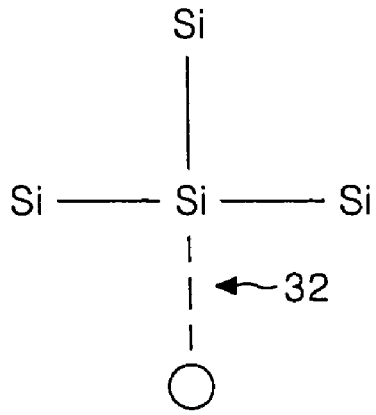
FIG.3B RELATED ART
Figure 4:
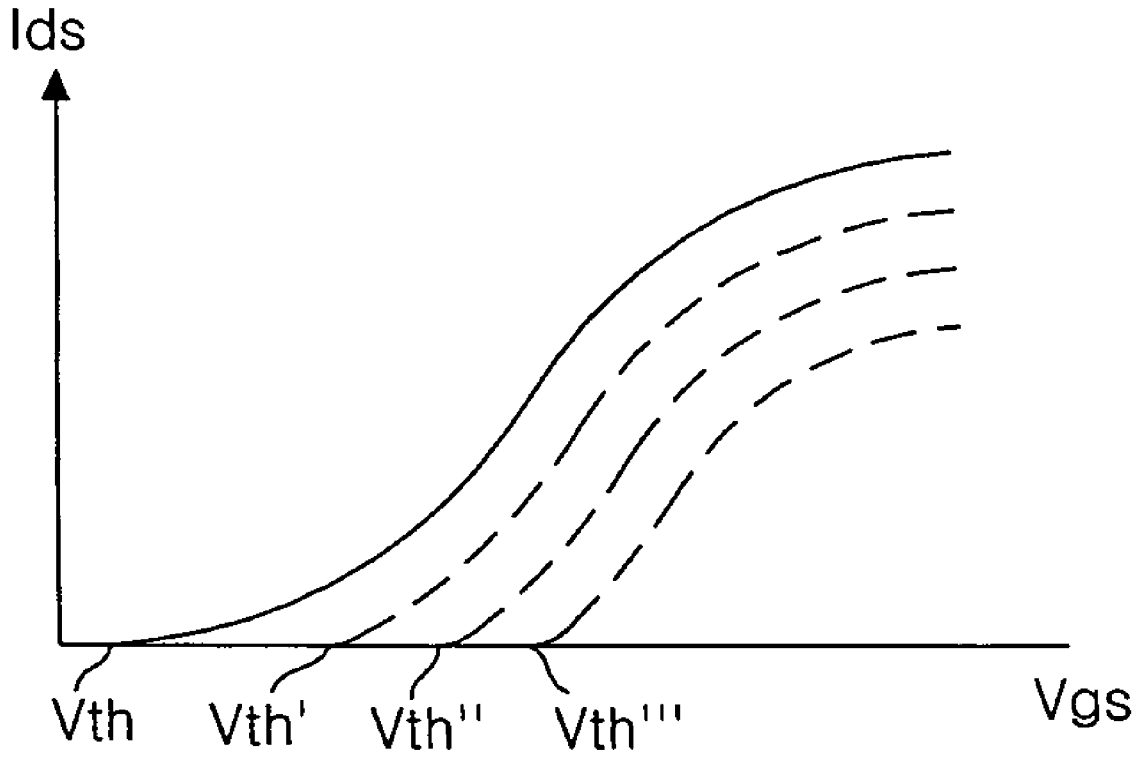
FIG. 4 RELATED ART
FIG. 4 is a graph illustrating a deterioration of a driving thin film transistor of the pixel shown in FIG. 2.
Figure 5:
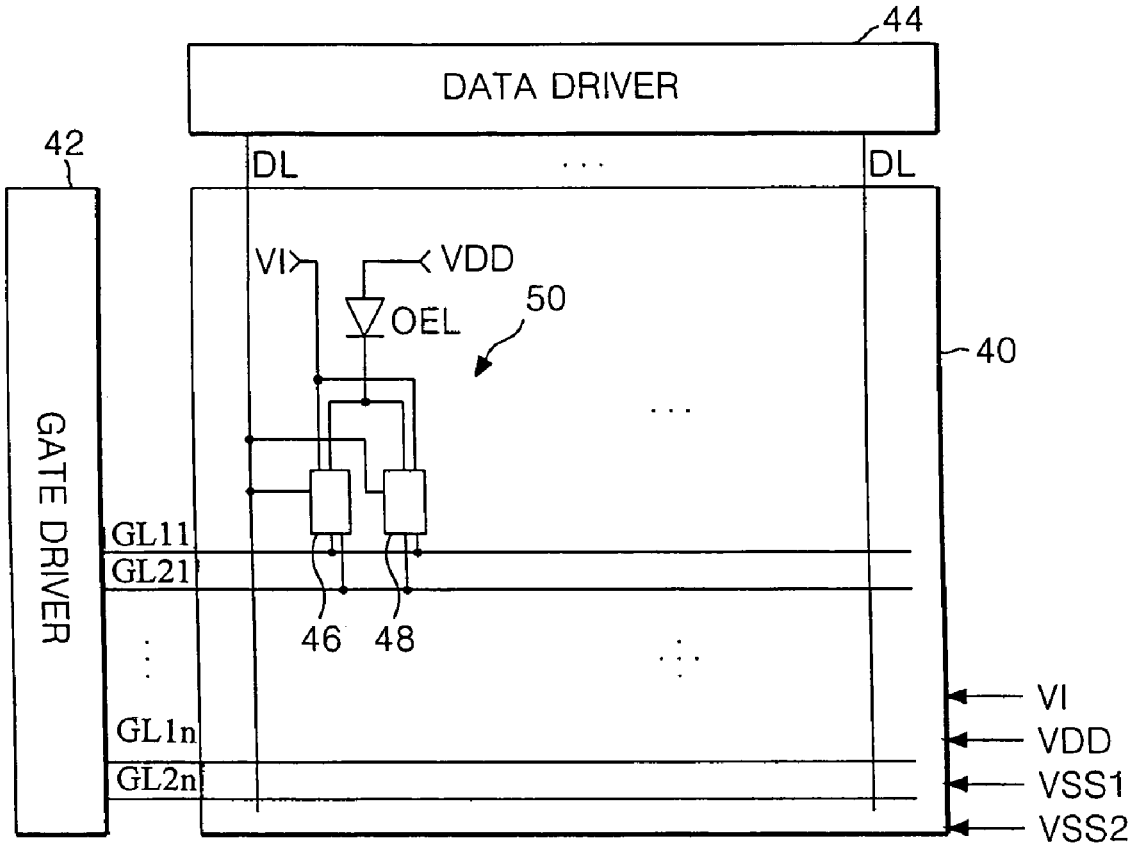
FIG. 5 is a schematic block diagram illustrating an electro-luminescence display device according to an embodiment of the present invention.

FIG. 5 is a schematic block diagram illustrating an electro-luminescence display device according to an embodiment of the present invention. In FIG. 5, an electro-luminescence (EL) display device includes an EL panel 40 having a plurality of first gate lines GL11 . . . GL1*n*, a plurality of second gate lines GL21 . . . GL2*n*, and a plurality of data lines DL, the gate lines GL11 . . . GL GL*n* and GL21 . . . GL2*n* intersecting the data lines DL. The number of the first gate lines GL11 . . . GL1*n* may be the same as the number of the second gate lines GL21 . . . GL2*n*, such that each of the second gate lines GL21 . . . GL2*n* is paired with a respective one of the first gate lines GL11 . . . GL1*n* for a horizontal display line of the EL panel 40.

In addition, the EL display device includes a gate driver 42 for driving the first and second gate lines GL11 . . . GL1*n* and GL21 . . . GL2*n*, a data driver 44 for driving the data lines DL, and at least one source (not shown) for supplying a supply voltage VDD, an inverse voltage VI, a first reference voltage VSS1 and a second reference voltage VSS2 to the EL panel 40. The EL panel 40 also includes a plurality of pixels 50 arranged at pixel areas defined by intersections between the gate lines GL11 . . . GL1*n* and GL21 . . . GL2*n* and the data lines DL.

Further, the gate driver 42 applies scanning pulses to the first gate lines GL11 . . . GL1*n* to sequentially drive the first gate lines GL11 . . . GL1*n* during an $i^{th}$ frame (i being an integer), and applies scanning pulses to the second gate lines GL21 . . . GL2*n* to sequentially drive the second gate lines GL21 . . . GL2*n* during an $(i+1)^{th}$ frame. The data driver 44 converts digital data signals inputted from an exterior source into analog data signals and applies the analog data signals to the data lines DL whenever the scanning pulse is supplied.

Moreover, each of the pixels 50 includes a first cell driver 46, a second cell driver 48 and an EL cell OEL. The first cell driver 46 receives a data signal from a respective one of the data lines DL when a scanning pulse is applied to a respective one of the first gate lines GL1, and controls the EL cell OEL to generate light corresponding to the received data signal. The second cell driver 48 receives a data signal from the respective data line DL when a scanning pulse is applied to a respective one of the second gate lines GL2, and controls the EL cell OEL to generate light corresponding to the received data signal. As a result, the first and second cell drivers 46 and 48 may alternately drive the EL cell OEL.

Further, the first cell driver 46 receives an inverse voltage VI when a scanning pulse is applied to the second gate line GL2 to apply an inverse bias voltage to the driving thin film transistor included in it. Further, the second cell driver 48 receives the inverse voltage VI when a scanning pulse is applied to the first gate line GL1 to apply an inverse bias voltage to the driving thin film transistor included in it. Further, the first and second cell drivers 46 and 48 apply an inverse bias voltage to the driving thin film transistor included in it alternately for each frame.

Figure 6:
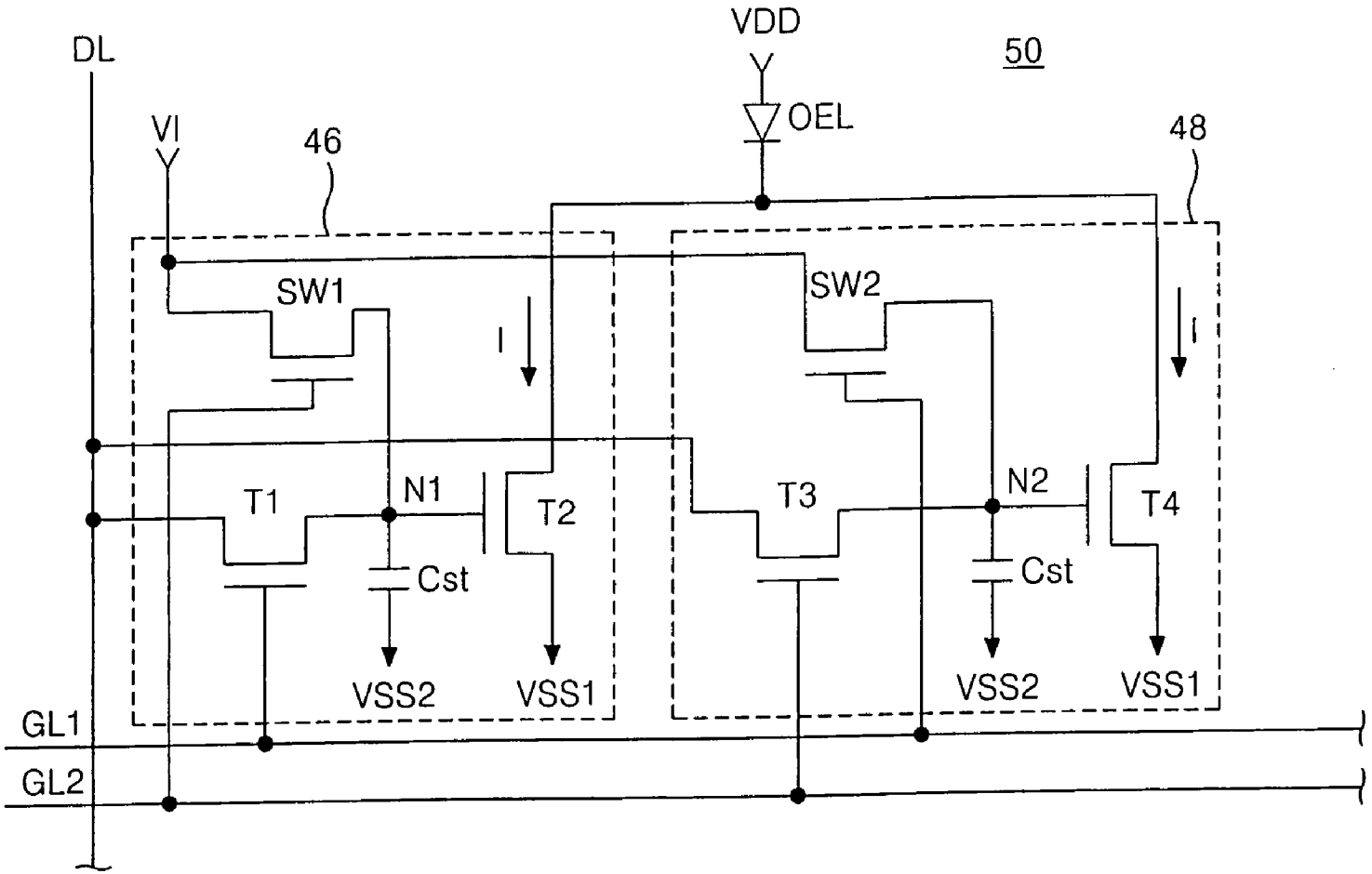
FIG. 6 is a detailed circuit diagram illustrating a pixel of the electro-luminescence display device shown in FIG. 5.

FIG. 6 is a detailed circuit diagram illustrating a pixel of the electro-luminescence display device shown in FIG. 5. As shown in FIG. 6, the EL cell OEL provided for each of the pixels 50 includes an anode connected to receive the supply voltage VDD, and a cathode connected to the first and second cell drivers 46 and 48.

The first cell driver 46 includes a first switching thin film transistor T1, a first driving thin film transistor. T2, a first bias switch SW1, and a first storage capacitor Cst. The first switching thin film transistor T1 includes a gate terminal connected to the respective first gate line GL1, a source terminal connected to the respective data line DL, and a drain terminal connected to a first node N1. The first driving thin film transistor T2 includes a gate terminal connected to the first node N1, a source terminal connected to a source supplying the first reference voltage VSS1, and a drain terminal connected to the EL cell OEL. In addition, the first storage capacitor Cst is connected between the first node N1 and a source supplying the second reference voltage VSS2. The first bias switch SW1 includes a source terminal connected to receive the inverse voltage VI, a gate terminal connected to the respective second gate line GL2, and a drain terminal connected to the first node N1.

In particular, voltage values of the first and second reference voltages VSS1 and VSS2 may be set lower than a voltage value of the supply voltage VDD, such that a current I flows, from a source supplying the supply voltage VDD via the EL cell OEL, through the first driving thin film transistor T2. Further, a voltage value of the supply voltage VDD may have a positive polarity. For instance, voltage values of the first and second reference voltages VSS1 and VSS2 may be less than a ground voltage GND. In particular, voltage values of the first and second reference voltages VSS1 and VSS2 generally may be set equal to each other. However, the first and second reference voltages VSS1 and VSS2 may equal to the ground voltage GND. Moreover, voltage values of the first and second reference voltages VSS1 and VSS2 may be different from each other due to various factors, e.g., a resolution of the EL panel 40 and a process condition of the EL panel 40.

When a scanning pulse is applied to the respective first gate line GL1, the first switching thin film transistor T1 is turned ON, to thereby apply a data signal supplied to the respective data line DL to the first node N1. Then, the data signal supplied to the first node N1 is charged into the first storage capacitor Cst and applied to the gate terminal of the first driving thin film transistor T2. Further, the first driving thin film transistor T2 controls the current amount I flowing from the source of the supply voltage VDD via the EL cell OEL into the source supplying the first reference voltage VSS1 in response to the data signal applied thereto. As a result, the EL cell OEL generates light corresponding to the current amount I. Furthermore, the first driving thin film transistor T2 may remain turned ON by the data signal charged in the first storage capacitor Cst even if the first switching thin film transistor T1 is turned OFF.

Further, the first bias switch SW1 is turned ON when a scanning pulse is applied to the respective second gate line GL2, to thereby apply the inverse voltage VI to the first node N1. A value of the inverse voltage VI may be set lower than the value of the first reference voltage VSS1. When the inverse voltage VI is lower than the first reference voltage VSS1, an inverse bias voltage is applied to the first driving thin film transistor T2. In other words, a voltage at the source terminal of the first driving thin film transistor T2 supplied with the first reference voltage VSS1 is higher than a voltage at the gate terminal thereof supplied with the inverse voltage VI. As a result, an inverse bias voltage is applied to the first driving thin film transistor T2 as the inverse voltage VI is supplied to the first node N1, thereby preventing the threshold voltage Vth of the first driving thin film transistor T2 from being increased with a lapse of time. Consequently, since the inverse bias voltage is supplied to the first driving thin film transistor T2 when the scanning pulse is applied to the respective second gate line GL2, a deterioration of the first driving thin film transistor T2 is prevented and the threshold voltage Vth of the first driving thin film transistor T2 is maintained constant even with a lapse of time.

The second cell driver 48 includes a second switching thin film transistor T3, a second driving thin film transistor T4, a second bias switch SW2, and a second storage capacitor Cst. The second switching thin film transistor T3 includes a gate terminal connected to the respective second gate line GL2, a source terminal connected to the respective data line DL, and a drain terminal connected to a second node N2. The second driving thin film transistor T4 includes a gate terminal connected to the second node N2, a source terminal connected to the source supplying the first reference voltage VSS1, and a drain terminal connected to the EL cell OEL. In addition, the second storage capacitor Cst is connected between the second node N1 and the source supplying the second reference voltage VSS2. The second bias switch SW2 includes a source terminal connected to receive the inverse voltage VI, a gate terminal connected to the respective first gate line GL1, and a drain terminal connected to the second node N2.

In particular, voltage values of the first and second reference voltages VSS1 and VSS2 may be set lower than a voltage value of the supply voltage VDD, such that a current I flows, from a source supplying the supply voltage VDD via the EL cell OEL, through the second driving thin film transistor T4.

When a scanning pulse is applied to the respective second gate line GL2, the second switching thin film transistor T3 is turned ON, to thereby apply a data signal supplied to the respective data line DL to the second node N2. Then, the data signal supplied to the second node N2 is charged into the second storage capacitor Cst and applied to the gate terminal of the second driving thin film transistor T4. Further, the second driving thin film transistor T4 controls the current amount I flowing from the source of the supply voltage VDD via the EL cell OEL into the source supplying the first reference voltage VSS1 in response to the data signal applied thereto. As a result, the EL cell OEL generates light corresponding to the current amount I. Furthermore, the second driving thin film transistor T4 may remain turned ON by the data signal charged in the second storage capacitor Cst even if the second switching thin film transistor T3 is turned OFF.

Further, the second bias switch SW2 is turned ON when a scanning pulse is applied to the respective first gate line GL1, to thereby apply the inverse voltage VI to the second node N2. When the inverse voltage VI is lower than the first reference voltage VSS1, an inverse bias voltage is applied to the second driving thin film transistor T4. In other words, a voltage at the source terminal of the second driving thin film transistor T4 supplied with the first reference voltage VSS1 is higher than a voltage at the gate terminal thereof supplied with the inverse voltage VI. As a result, an inverse bias voltage is applied to the second driving thin film transistor T4 as the inverse voltage VI is supplied to the second node N2, thereby preventing the threshold voltage Vth of the second driving thin film transistor T4 from being increased with a lapse of time. Consequently, since the inverse bias voltage is supplied to the second driving thin film transistor T4 when the scanning pulse is applied to the respective first gate line GL1, a deterioration of the second driving thin film transistor T4 is prevented and the threshold voltage Vth of the second driving thin film transistor T4 is maintained constant even with a lapse of time.

Figure 7:
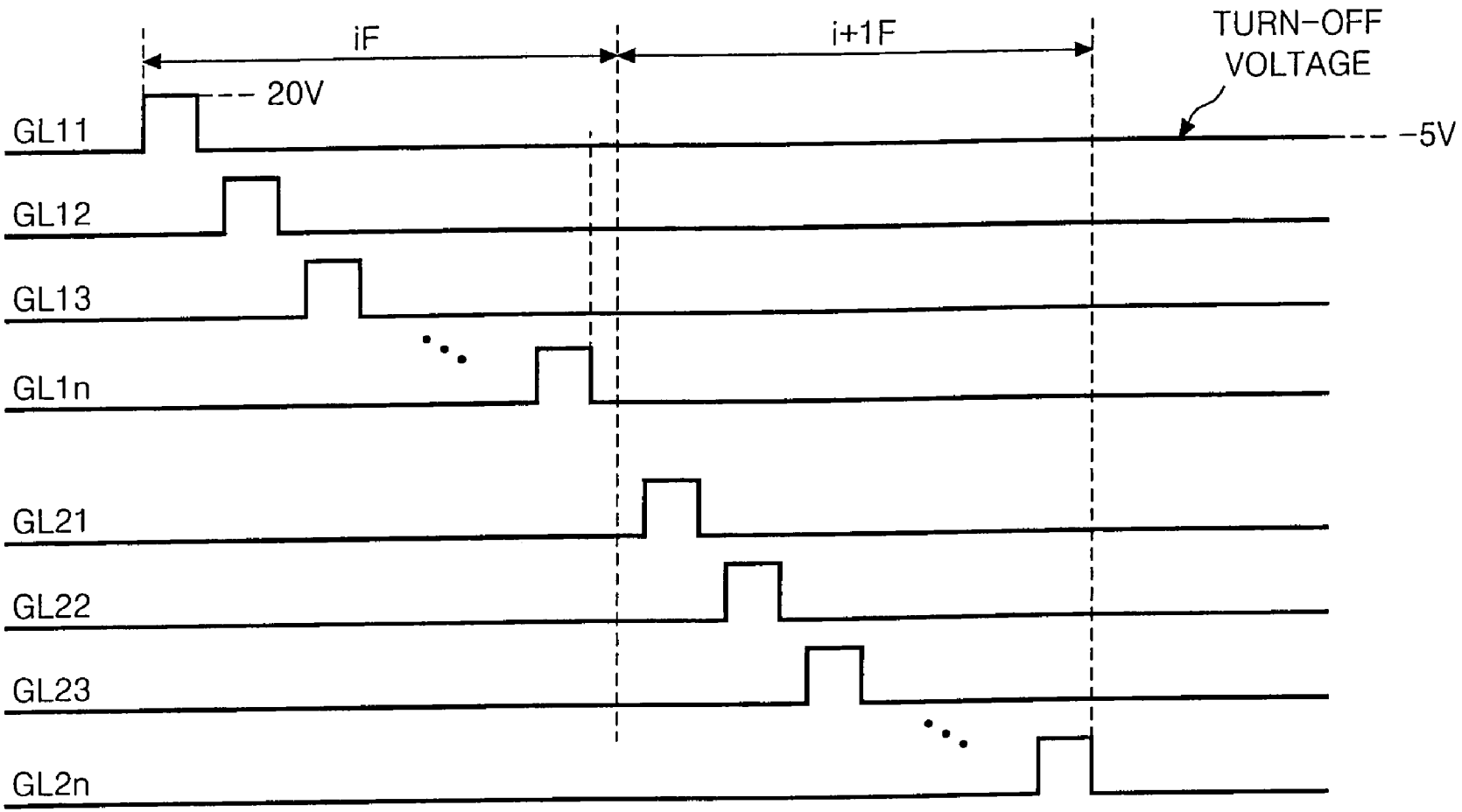
FIG. 7 is a waveform diagram illustrating scanning pulses applied to gate lines of the electro-luminescence display device shown in FIG. 5.

FIG. 7 is a waveform diagram illustrating scanning pulses applied to gate lines of the electro-luminescence display device shown in FIG. 5. As shown in FIG. 7, during an $i^{th}$ frame iF, a HIGH-state scanning pulse may be applied sequentially from the gate driver 42 (shown in FIG. 5) to the first gate lines GL11 . . . GL1*n*, thereby sequentially driving the first gate lines GL11 . . . GL1*n*. In addition, during an $(i+1)^{th}$ frame i+1F, the HIGH-state scanning pulse may be applied sequentially from the gate driver 42 (shown in FIG. 5) to the second gate lines GL21 . . . . GL2*n*, thereby sequentially driving the second gate lines GL21 . . . GL2*n*. Further, a turn-off signal may be applied to the first and second gate lines GL11 . . . GL1*n* and GL21 . . . GL2*n* when the HIGH-state scanning pulse is not applied thereto. The HIGH-state scanning pulse may have a voltage level of about 20V, and the turn-off signal may have a voltage level of about −5V.

Referring to FIGS. 6 and 7, when the HIGH-state scanning pulse is applied to the first gate line GL1, the first switching thin film transistor T1 of the first cell driver 46 connected to the first gate line GL1 is turned ON. As the first switching thin film transistor T1 is turned ON, a data signal supplied to the data line DL is applied to the first node N1 of the first cell driver 46. Then, the first driving thin film transistor T2 of the first cell driver 46 is turned ON by the data signal applied to the first node N1, thereby applying the current I corresponding to the data signal from a source supplying the supply voltage VDD to the first reference voltage VSS1 and thus generating light corresponding to the current I from the EL cell OEL.

Thus, during the $i^{th}$ frame iF when the HIGH-state scanning pulse is sequentially applied to the first gate lines GL11 . . . GL1*n*, the pixels 50 may be sequentially driven line-by-line by the first cell drivers 46.

Further, when the HIGH-state scanning pulses are sequentially applied to the first gate lines GL11 . . . GL1*n*, the second bias switch SW2 of the second cell driver 48 for each pixel 50 is turned ON. When the second bias switch SW2 is turned ON, the inverse voltage VI is applied to the gate terminal of the second driving thin film transistor T4. Since a potential VSS1 at the source terminal of the second driving thin film transistor T4 is higher than a potential VI at the gate terminal of the second driving thin film transistor T4, an inverse bias voltage is applied to the second driving thin film transistor T4 when the scanning pulses are applied to the first gate lines GL1, thereby preventing a deterioration of the second driving thin film transistor T4.

In addition, when the HIGH-state scanning pulse is applied to the second gate line GL2, the second switching thin film transistor T3 of the second cell driver 48 connected to the second gate line GL2 is turned ON. As the second switching thin film transistor T3 is turned ON, a data signal supplied to the data line DL is applied to the second node N2 of the second cell driver 48. Then, the second driving thin film transistor T4 of the second cell driver 48 is turned ON by the data signal applied to the second node N2, thereby applying the current I corresponding to the data signal from a source supplying the supply voltage VDD to the first reference voltage VSS1 and thus generating light corresponding to the current I from the EL cell OEL.

Thus, during the $(i+1)^{th}$ frame i+1F when the HIGH-state scanning pulse is sequentially applied to the second gate lines GL21 . . . GL2*n*, the pixels 50 may be sequentially driven line-by-line by the second cell drivers 48.

Moreover, when the HIGH-state scanning pulses are sequentially applied to the second gate lines GL21 . . . GL2*n*, the first bias switch SW1 of the first cell driver 46 for each pixel 50 is turned ON. When the first bias switch SW1 is turned ON, the inverse voltage VI is applied to the gate terminal of the first driving thin film transistor T2. Since a potential VSS1 at the source terminal of the first driving thin film transistor T2 is higher than a potential VI at the gate terminal of the first driving thin film transistor T2, an inverse bias voltage is applied to the first driving thin film transistor T2 when the scanning pulses are applied to the second gate lines GL2, thereby preventing a deterioration of the first driving thin film transistor T2.

Figure 8:
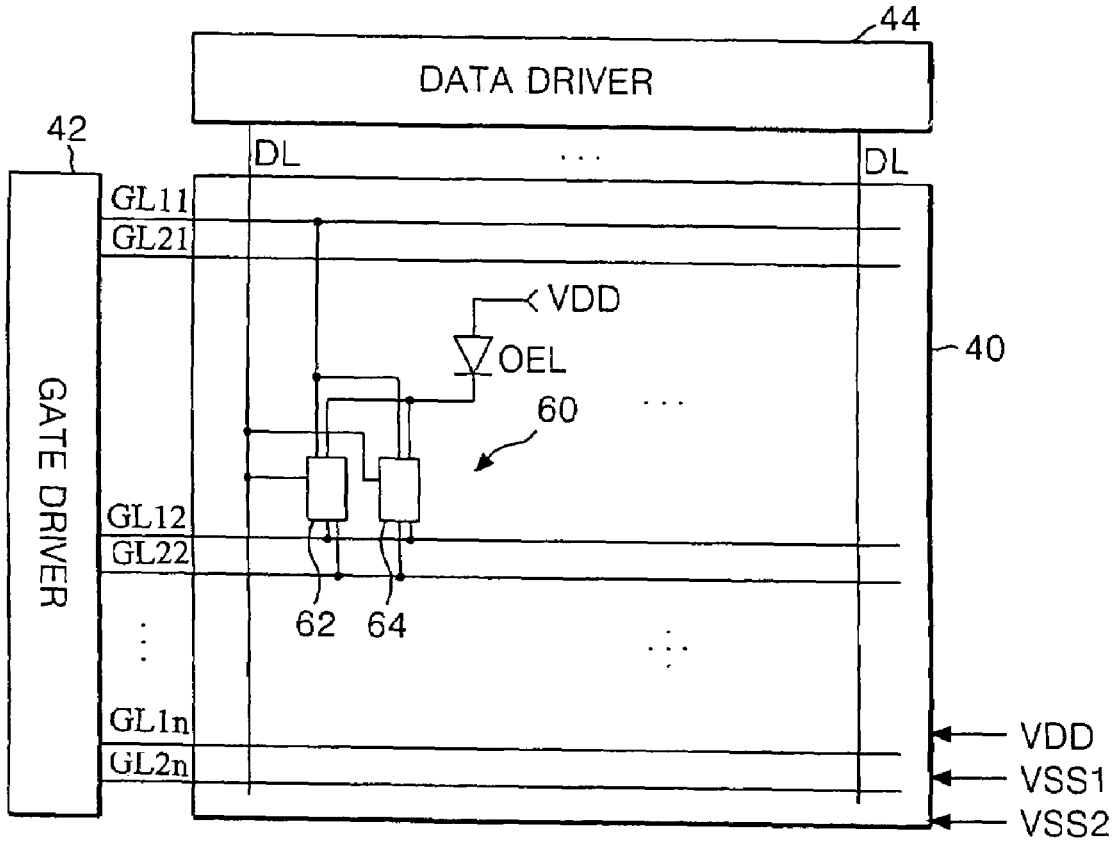
FIG. 8 is a schematic block diagram illustrating an electro-luminescence display device according to another embodiment of the present invention.

FIG. 8 is a schematic block diagram illustrating an electro-luminescence display device according to another embodiment of the present invention. In FIG. 8, an electro-luminescence (EL) display device includes an EL panel 40 having a plurality of first gate lines GL11 . . . GL1*n*, a plurality of second gate lines GL21 . . . GL2*n*, and a plurality of data lines DL, the gate lines GL11 . . . GL1*n* and GL21 . . . GL2*n* intersecting the data lines DL. The number of the first gate lines GL11 . . . GL1*n* may be the same as the number of the second gate lines GL21 . . . GL2*n*, such that each of the second gate lines GL21 . . . GL2*n* is paired with a respective one of the first gate lines GL11 . . . GL1*n* for a horizontal display line of the EL panel 40.

In addition, the EL display device includes a gate driver 42 for driving the first and second gate lines GL11 . . . GL1*n* and GL21 . . . GL2*n*, a data driver 44 for driving the data lines DL, and at least one source (not shown) for supplying a supply voltage VDD, a first reference voltage VSS1 and a second reference voltage VSS2 to the EL panel 40. The EL panel 40 also includes a plurality of pixels 60 arranged at pixel areas defined by intersections between the gate lines GL11 . . . GL1*n* and GL21 . . . GL2*n* and the data lines DL.

Further, the gate driver 42 applies scanning pulses to the first gate lines GL11 . . . GL1*n* to sequentially drive the first gate lines GL11 . . . GL1*n* during an $i^{th}$ frame (i being an integer), and applies scanning pulses to the second gate lines GL21 . . . GL2*n* to sequentially drive the second gate lines GL21 . . . GL2*n* during an $(i+1)^{th}$ frame. For example, the gate driver 42 may drive the first and second gate lines GL11 . . . GL1*n* and GL21 . . . GL2*n* as shown in FIG. 7. The data driver 44 converts digital data signals inputted from an exterior source into analog data signals and applies the analog data signals to the data lines DL whenever the scanning pulse is supplied.

Moreover, each of the pixels 60 includes a first cell driver 62, a second cell driver 64 and an EL cell OEL. The first cell driver 62 receives a data signal from a respective one of the data lines DL when a scanning pulse is applied to a respective one of the first gate lines GL1*j*, and controls the EL cell OEL to generate light corresponding to the received data signal. At the same time, the first cell driver 62 also may receive a turn-off signal from one of the (j−1) first and second gate lines GL1(j−1) and GL2(j−1), thereby applying an inverse bias voltage to the first cell driver 62. The second cell driver 64 receives a data signal from the respective data line DL when a scanning pulse is applied to a respective one of the second gate lines GL2*j*, and controls the EL cell OEL to generate light corresponding to the received data signal. At the same time, the second cell driver 64 also may receive a turn-off signal from one of the (j−1) first and second gate lines GL1(j−1) and GL2(j−1), thereby applying an inverse bias voltage to the second cell driver 64. As a result, each of the pixels 60 receives the data signal when the scanning pulse is applied to the respective first gate line GL1*j* or the respective second gate line GL2*j*, and the first and second cell drivers 62 and 64 may alternately drive the EL cell OEL.

Figure 9:
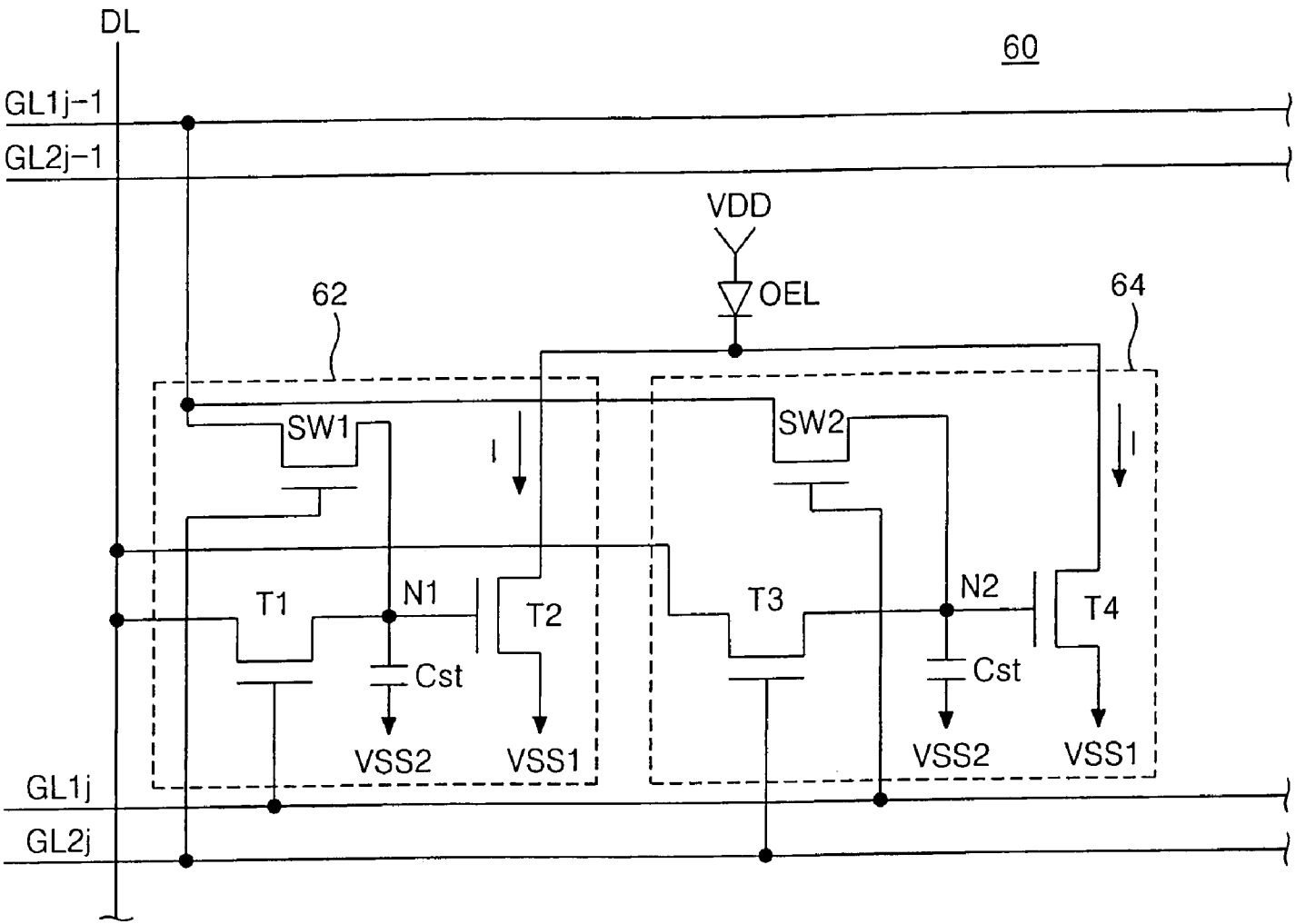
FIG. 9 is a detailed circuit diagram illustrating a pixel of the electro-luminescence display device shown in FIG. 8.

FIG. 9 is a detailed circuit diagram illustrating a pixel of the electro-luminescence display device shown in FIG. 8. As shown in FIG. 9, the EL cell OEL provided for each of the pixels 60 includes an anode connected to receive the supply voltage VDD, and a cathode connected to the first and second cell drivers 62 and 64.

For instance, for the pixel 60 corresponding to an $j^{th}$ horizontal display line of the EL panel 40 (shown in FIG. 8), the first cell driver 46 includes a first switching thin film transistor T1, a first driving thin film transistor T2, a first bias switch SW1, and a first storage capacitor Cst. The first switching thin film transistor T1 includes a gate terminal connected to the respective first gate line GL1*j*, a source terminal connected to the respective data line DL, and a drain terminal connected to a first node N1. The first driving thin film transistor T2 includes a gate terminal connected to the first node N1, a source terminal connected to a source supplying the first reference voltage VSS1, and a drain terminal connected to the EL cell OEL. In addition, the first storage capacitor Cst is connected between the first node N1 and a source supplying the second reference voltage VSS2. The first bias switch SW1 includes a source terminal connected to the immediately prior first gate line GL1(j−1), a gate terminal connected to the respective second gate line GL2*j*, and a drain terminal connected to the first node N1. Although not shown, the source terminal of the first bias switch SW1 may alternatively connect to the immediately prior second gate line GL2(j−1).

In particular, voltage values of the first and second reference voltages VSS1 and VSS2 may be set lower than a voltage value of the supply voltage VDD, such that a current I flows, from a source supplying the supply voltage VDD via the EL cell OEL, through the first driving thin film transistor T2. Further, a voltage value of the supply voltage VDD may have a positive polarity. For instance, voltage values of the first and second reference voltages VSS1 and VSS2 may be less than a ground voltage GND. In particular, voltage values of the first and second reference voltages VSS1 and VSS2 generally may be set equal to each other. However, the first and second reference voltages VSS1 and VSS2 may equal to the ground voltage GND. Moreover, voltage values of the first and second reference voltages VSS1 and VSS2 may be different from each other due to various factors, e.g., a resolution of the EL panel 40 and a process condition of the EL panel 40.

When a scanning pulse is applied to the respective first gate line GL1*j*, the first switching thin film transistor T1 is turned ON, to thereby apply a data signal supplied to the respective data line DL to the first node N1. Then, the data signal supplied to the first node N1 is charged into the first storage capacitor Cst and applied to the gate terminal of the first driving thin film transistor T2. Further, the first driving thin film transistor T2 controls the current amount I flowing from the source of the supply voltage VDD via the EL cell OEL into the source supplying the first reference voltage VSS1 in response to the data signal applied thereto. As a result, the EL cell OEL generates light corresponding to the current amount I. Furthermore, the first driving thin film transistor T2 may remain turned ON by the data signal charged in the first storage capacitor Cst even if the first switching thin film transistor T1 is turned OFF.

Further, the first bias switch SW1 is turned ON when a scanning pulse is applied to the respective second gate line GL2*j*, to thereby apply the turn-off voltage from the immediately prior first gate line GL1(j−1) to the first node N1. A value of the turn-off voltage may be set lower than the value of the first reference voltage VSS1. When the turn-off voltage VI is lower than the first reference voltage VSS1, an inverse bias voltage is applied to the first driving thin film transistor T2. In other words, a voltage at the source terminal of the first driving thin film transistor T2 supplied with the first reference voltage VSS1 is higher than a voltage at the gate terminal thereof supplied with the turn-off voltage. As a result, an inverse bias voltage is applied to the first driving thin film transistor T2 as the turn-off voltage is supplied to the first node N1, thereby preventing the threshold voltage Vth of the first driving thin film transistor T2 from being increased with a lapse of time without using an additional source for supplying an inverse voltage. Consequently, since the inverse bias voltage is supplied to the first driving thin film transistor T2 when the scanning pulse is applied to the respective second gate line GL2*j*, a deterioration of the first driving thin film transistor T2 is prevented and the threshold voltage Vth of the first driving thin film transistor T2 is maintained constant even with a lapse of time.

The second cell driver 64 includes a second switching thin film transistor T3, a second driving thin film transistor T4, a second bias switch SW2, and a second storage capacitor Cst. The second switching thin film transistor T3 includes a gate terminal connected to the respective second gate line GL2*j*, a source terminal connected to the respective data line DL, and a drain terminal connected to a second node N2. The second driving thin film transistor T4 includes a gate terminal connected to the second node N2, a source terminal connected to the source supplying the first reference voltage VSS1, and a drain terminal connected to the EL cell OEL. In addition, the second storage capacitor Cst is connected between the second node N1 and the source supplying the second reference voltage VSS2. The second bias switch SW2 includes a source terminal connected to receive the immediately prior first gate line GL1(j−1), a gate terminal connected to the respective first gate line GL1*j*, and a drain terminal connected to the second node N2. Although not shown, the source terminal of the second bias switch SW2 alternatively may connect to the immediately prior second gate line GL2(j−1).

In particular, voltage values of the first and second reference voltages VSS1 and VSS2 may be set lower than a voltage value of the supply voltage VDD, such that a current I flows, from a source supplying the supply voltage VDD via the EL cell OEL, through the second driving thin film transistor T4.

When a scanning pulse is applied to the respective second gate line GL2*j*, the second switching thin film transistor T3 is turned ON, to thereby apply a data signal supplied to the respective data line DL to the second node N2. Then, the data signal supplied to the second node N2 is charged into the second storage capacitor Cst and applied to the gate terminal of the second driving thin film transistor T4. Further, the second driving thin film transistor T4 controls the current amount I flowing from the source of the supply voltage VDD via the EL cell OEL into the source supplying the first reference voltage VSS1 in response to the data signal applied thereto. As a result, the EL cell OEL generates light corresponding to the current amount I. Furthermore, the second driving thin film transistor T4 may remain turned ON by the data signal charged in the second storage capacitor Cst even if the second switching thin film transistor T3 is turned OFF.

Further, the second bias switch SW2 is turned ON when a scanning pulse is applied to the respective first gate line GL1*j*, to thereby apply the turn-off voltage from the immediately prior first gate line GL1(j−1) to the second node N2. When the turn-off voltage is lower than the first reference voltage VSS1, an inverse bias voltage is applied to the second driving thin film transistor T4. In other words, a voltage at the source terminal of the second driving thin film transistor T4 supplied with the first reference voltage VSS1 is higher than a voltage at the gate terminal thereof supplied with the turn-off voltage. As a result, an inverse bias voltage is applied to the second driving thin film transistor T4 as the turn-off voltage is supplied to the second node N2, thereby preventing the threshold voltage Vth of the second driving thin film transistor T4 from being increased with a lapse of time without using an additional source for supplying an inverse voltage. Consequently, since the inverse bias voltage is supplied to the second driving thin film transistor T4 when the scanning pulse is applied to the respective first gate line GL1*j*, a deterioration of the second driving thin film transistor T4 is prevented and the threshold voltage Vth of the second driving thin film transistor T4 is maintained constant even with a lapse of time.

Figure 10A:
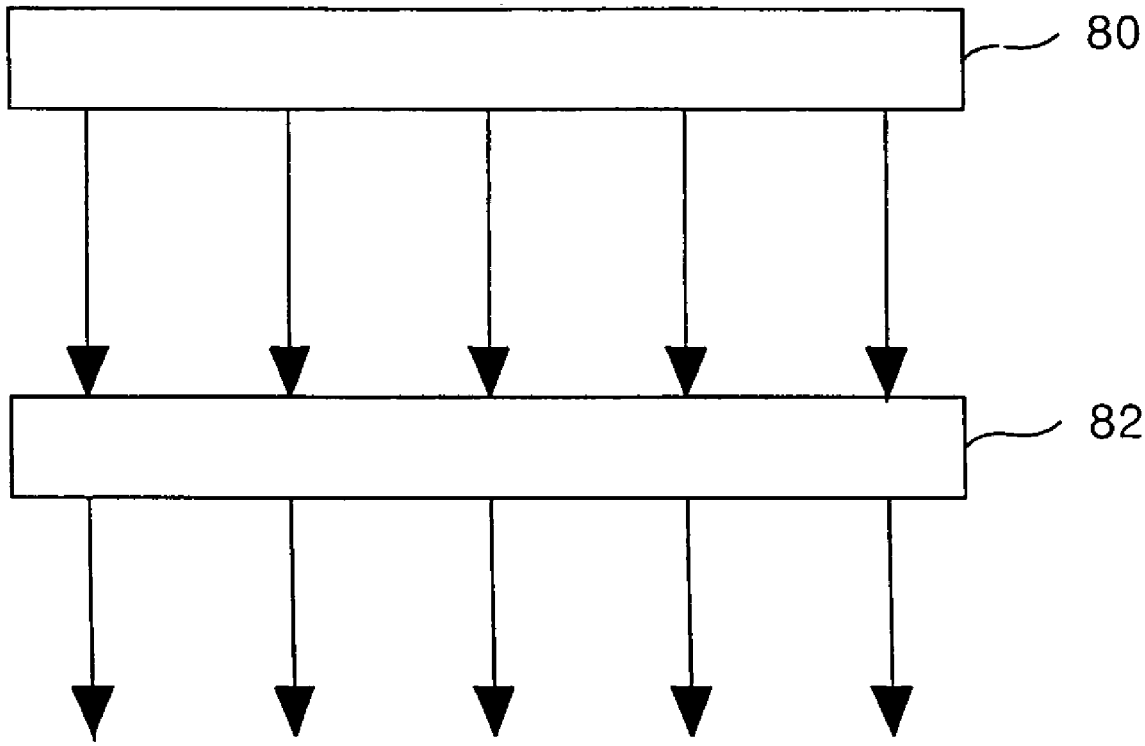
FIGS. 10A and 10B are schematic diagrams illustrating light emission of an electro-luminescence display device according to an embodiment of the present invention.
Figure 10B:
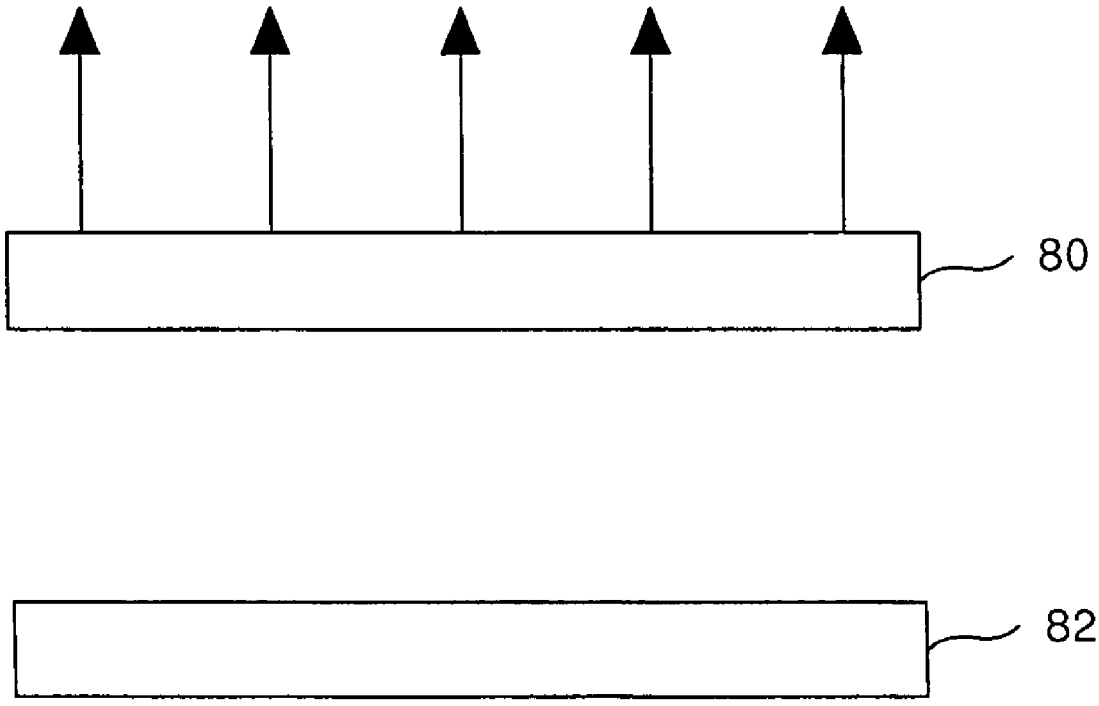

FIGS. 10A and 10B are schematic diagrams illustrating light emission of an electro-luminescence display device according to an embodiment of the present invention. As shown in FIG. 10A, the electro-luminescence display device may include a first substrate 80 having an EL formed thereon and a second substrate 82 having cell drivers formed thereon. In particular, light may be generated from the first substrate 80 and be transmitted through the second substrate 82 to an observer. However, as the number of switching devices formed on the second substrate 82 increases, more light may be blocked off by the second substrate 82, thereby reducing an aperture ratio of the electro-luminescence display device.

To avoid reducing the aperture ratio, light alternatively may be emitted directly from the first substrate 80 to the observer as shown in FIG. 10B. For instance, the switching devices at the second substrate 82 may control the EL at the first substrate 80 to emit light. Then, light generated from the first substrate 80 is emitted in a direction opposite from the second substrate 82, such that light does not transmit through the second substrate 82. Accordingly, a high aperture ratio is achieved irrespectively of the number of switching devices at the second substrate 82. Thus, even when each pixel includes two driving cells as shown in FIGS. 5 and 8, the electro-luminescence display device still has a high aperture ratio while providing a stable brightness. Furthermore, the switching devices at the second substrate 82, e.g., the thin film transistors T1 to T4 and the bias switches SW1 and SW2, may be formed from a wider range of materials, especially since these switching devices need not be formed of a transparent material. For instance, the thin film transistors T1 to T4 and the bias switches SW1 and SW2 may be formed of amorphous silicon (a-Si), polycrystalline silicon (p-Si), or the like.

As described above, an electro-luminescence display device according to an embodiment of the present invention includes the first and second cell drivers for each pixel. The first and second cell drivers are driven alternately with each other, to thereby control a current flowing into the EL cell. Further, when a specific cell driver is driven, an inverse bias voltage is applied to the driving thin film transistor of the remaining cell driver, thereby preventing a deterioration of the driving thin film transistor. Accordingly, a deterioration of the driving thin film transistor is prevented and image is displayed with a stable brightness.

It will be apparent to those skilled in the art that various modifications and variations can be made in the electro-luminescence display device and the driving method thereof of the present invention without departing from the sprit or scope of the invention. Thus, it is intended that the present invention covers the modifications and variations of this invention provided they come within the scope of the appended claims and their equivalents.

What is claimed is:

1. An electro-luminescence display device comprising:

an electro-luminescence panel having a plurality of pixels at pixel areas defined by intersections between data lines and first and second gate lines, each of the pixels including:

an electro-luminescence cell connected to receive a supply voltage; and a first cell driver and a second cell driver for alternately controlling a current flow into the electro-luminescence cell.

2. The electro-luminescence display device according to claim 1, wherein the first cell driver includes a first driving thin film transistor and a first bias switch, the first bias switch connected to a gate terminal of the first driving thin film transistor for selectively applying an inverse voltage to the first driving thin film transistor.

3. The electro-luminescence display device according to claim 2, wherein the second cell driver includes a second driving thin film transistor and a second bias switch, the second bias switch connected to a gate terminal of the second driving thin film transistor for selectively applying the inverse voltage to the second driving thin film transistor.

4. The electro-luminescence display device according to claim 3, wherein the first driving thin film transistor has a drain terminal connected to the electro-luminescence cell and a source terminal connected to a first reference voltage source, and the second driving thin film transistor has a drain terminal connected to the electro-luminescence cell and a source terminal connected to the first reference voltage source.

5. The electro-luminescence display device according to claim 4, wherein the first cell driver includes:

a first switching thin film transistor connected to the first driving thin film transistor, a respective one of the data lines, and a respective one of the first gate lines, the first switching thin film transistor applying a data signal supplied by the respective data line to the first driving thin film transistor of a same pixel area when a scanning pulse is applied to the respective first gate line; and a first storage capacitor connected between the gate terminal of the first driving thin film transistor and a second reference voltage source.

6. The electro-luminescence display device according to claim 5, wherein the second cell driver includes:

a second switching thin film transistor connected to the second driving thin film transistor, a respective one of the data lines, and a respective one of the second gate lines, the second switching thin film transistor applying a data signal supplied by the respective data line to the second driving thin film transistor of a same pixel area when a scanning pulse is applied to the respective second gate line; and a second storage capacitor connected between the gate terminal of the second driving thin film transistor and the second reference voltage source.

7. The electro-luminescence display device according to claim 6, wherein the first reference voltage source and the second reference voltage source supply reference voltages having voltage values lower than a voltage value of the supply voltage.

8. The electro-luminescence display device according to claim 6, wherein the inverse voltage has a voltage value lower than voltage values of reference voltages supplied by the first and second voltage sources.

9. The electro-luminescence display device according to claim 6, wherein the first and second reference voltage source supplies provide reference voltages having the same voltage values.

10. The electro-luminescence display device according to claim 2, further comprising an inverse voltage source for supplying the inverse voltage.

11. The electro-luminescence display device according to claim 2, wherein the first bias switch for the pixel connected to a $j^{th}$ one of the first and second gate lines (GL1*j* and GL2*j*, j being an integer) includes:

a drain terminal connected to the gate terminal of the first driving thin film transistor of the pixel;

a source terminal connected to an inverse voltage source, the inverse voltage source supplying the inverse voltage; and a gate terminal connected to the $j^{th}$ second gate line (GL2*j*).

12. The electro-luminescence display device according to claim 11, wherein the first bias switch for the pixel connected to the $j^{th}$ first and second gate lines (GL1*j* and GL2*j*) applies the inverse voltage supplied from the inverse voltage source to the gate terminal of the first driving thin film transistor of the pixel when a scanning pulse is applied to the $j^{th}$ second gate line (GL2*j*).

13. The electro-luminescence display device according to claim 12, wherein the second bias switch for the pixel connected to the $j^{th}$ first and second gate lines (GL1*j* and GL2*j*) includes:

a drain terminal connected to the gate terminal of the second driving thin film transistor of the pixel;

a source terminal connected to the inverse voltage source; and a gate terminal connected to the $j^{th}$ first gate line (GL1*j*).

14. The electro-luminescence display device according to claim 13, wherein the second bias switch for the pixel connected to the $j^{th}$ first and second gate lines (GL1*j* and GL2*j*) applies the inverse voltage supplied from the inverse voltage source to the gate terminal of the second driving thin film transistor of the pixel when the scanning pulse is applied to the $j^{th}$ first gate line (GL1*j*).

15. The electro-luminescence display device according to claim 2, wherein the first bias switch for the pixel connected to a $j^{th}$ one of the first and second gate lines (GL1*j* and GL2*j*, *j* being an integer) includes:

a drain terminal connected to the gate terminal of the first driving thin film transistor of the pixel;

a source terminal connected to a $(j-1)^{th}$ first gate line (GL1*j*−1) or a $(j-1)^{th}$ second gate line (GL2*j*−1); and a gate terminal connected to the $j^{th}$ second gate line (GL2*j*).

16. The electro-luminescence display device according to claim 15, wherein the first bias switch for the pixel connected to the $j^{th}$ first and second gate lines (GL1*j* and GL2*j*) applies a turn-off voltage as the inverse voltage to the gate terminal of the first driving thin film transistor of the pixel when a scanning pulse is applied to the $j^{th}$ second gate line (GL2*j*).

17. The electro-luminescence display device according to claim 16, wherein the turn-off voltage has a value lower than a value of a reference voltage applied to a source terminal of the first driving thin film transistor.

18. The electro-luminescence display device according to claim 17, wherein the second bias switch for the pixel connected to the $j^{th}$ first and second gate lines (GL1*j* and GL2*j*) includes:

a drain terminal connected to the gate terminal of the second driving thin film transistor of the pixel;

a source terminal connected to one of the $(j-1)^{th}$ first gate line (GL1*j*−1) and $(j-1)^{th}$ second gate line (GL2*j*−1); and a gate terminal connected to the $j^{th}$ first gate line (GL1*j*).

19. The electro-luminescence display device according to claim 18, wherein the second bias switch for the pixel connected to the $j^{th}$ first and second gate lines (GL1*j* and GL2*j*) applies the turn-off voltage as the inverse voltage to the gate terminal of the second driving thin film transistor of the pixel when a scanning pulse is applied to the $j^{th}$ first gate line (GL1*j*).

20. The electro-luminescence display device according to claim 19, wherein the turn-off voltage has a value lower than a value of a reference voltage applied to a source terminal of the second driving thin film transistor.

21. The electro-luminescence display device according to claim 1, further comprising a gate driver sequentially applying scanning pulses to the first gate lines during an $i^{th}$ frame (wherein i is an odd number or an even number) and sequentially applying the scanning pulses to the second gate lines during an $(i+1)^{th}$ frame.

22. An electro-luminescence display device comprising:

first and second gate lines for each horizontal line;

a plurality of electro-luminescence cells for each of pixels arranged in a matrix-like manner;

a first cell driver having a first driving thin film transistor for each pixel to control a current flowing into the electro-luminescence cell when a scanning pulse is applied to the first gate line; and a second cell driver having a second driving thin film transistor for each pixel to control the current flowing into the electro-luminescence cell when the scanning pulse is applied to the second gate line.

23. The electro-luminescence display device according to claim 22, wherein the first cell driver positioned at a $j^{th}$ horizontal line (wherein j is an integer) applies an inverse bias voltage to the first driving thin film transistor when the scanning pulse is applied to the second gate line.

24. The electro-luminescence display device according to claim 23, wherein, the inverse bias voltage has a value lower than a value of a reference voltage applied to a source terminal of the first driving thin film transistor.

25. The electro-luminescence display device according to claim 23, wherein the second cell driver positioned at the $j^{th}$ horizontal line (wherein j is an integer) applies the inverse bias voltage to the second driving thin film transistor when the scanning pulse is applied to the first gate line.

26. The electro-luminescence display device according to claim 25, wherein the inverse bias voltage has a value lower than a value of a reference voltage applied to a source terminal of the second driving thin film transistor.

27. The electro-luminescence display device according to claim 23, further comprising:

a voltage supplier for supplying the inverse bias voltage.

28. The electro-luminescence display device according to claim 23, wherein the inverse bias voltage is a turn-off voltage supplied to one of the first and second gate lines for a $(j-1)^{th}$ horizontal line.

29. A method of driving an electro-luminescence display device having a first cell driver and a second cell driver for each of pixels arranged in a matrix-like manner, comprising:

applying a scanning pulse to first and second gate lines;

applying a data signal to one of the first and second cell drivers for the pixel for a $j^{th}$ one of horizontal line (j being an integer) and supplying an inverse bias voltage to another one of the first and second cell driver for the pixel, when the scanning pulse is applied to a $j^{th}$ one of the first gate lines (GL1*j*) or a $j^{th}$ one of the second gate lines (GL2*j*); and controlling a current flowing from a supply voltage source, via an electro-luminescence cell for the pixel, to a reference voltage source based on said data signal.

30. The method according to claim 29, wherein the scanning pulse is sequentially applied to the first gate lines during an $i^{th}$ frame (wherein i is an odd number or an even number) and is sequentially applied to the second gate lines during an $(i+1)^{th}$ frame.

31. The method according to claim 30, wherein the first cell driver controls the current flowing into the electro-luminescence cell for the pixel when the scanning pulse is applied to the $j^{th}$ first gate line (GL1*j*).

32. The method according to claim 30, wherein the inverse bias voltage is supplied to the second cell driver for the pixel when the scanning pulse is applied to the $j^{th}$ first gate line (GL1*j*).

33. The method according to claim 32, further comprising setting a voltage value of the inverse bias voltage to be lower than a voltage value of a reference voltage, the inverse bias voltage being applied to a gate terminal of a driving thin film transistor included in the second cell driver and the reference voltage being applied to a source terminal of the driving thin film transistor in the second cell driver.

34. The method according to claim 33, wherein the second cell driver controls the current flowing into the electro-luminescence cell for the pixel when the scanning pulse is applied to the $j^{th}$ second gate line (GL2*j*).

35. The method according to claim 34, wherein the inverse bias voltage is supplied to the first cell driver for the pixel when the scanning pulse is applied to the $j^{th}$ second gate line (GL2*j*).

36. The method according to claim 35, wherein the inverse bias voltage is applied to a gate terminal of a driving thin film transistor included in the first cell driver and the reference voltage is applied to a source terminal of the driving thin film transistor in the first cell driver.

37. The method according to claim 29, wherein the inverse bias voltage is supplied by an inverse voltage source.

38. The method according to claim 29, further comprising applying a turn-off signal to the first and second gate lines when the scanning pulse is not applied thereto.

39. The method according to claim 38, wherein the turn-off signal is applied as the inverse bias voltage.

* * * * *